US005676714A

United States Patent [19]

Kodate

[11] Patent Number: 5,676,714

[45] Date of Patent: Oct. 14, 1997

[54] METHOD AND COMPOSITION FOR POLISHING PAINTED SURFACES

[76] Inventor: Tadao Kodate, 2-30-1, Miyahara, Ohmiya-Shi, Saitama-Ken, Japan

[21] Appl. No.: 576,930

[22] Filed: Dec. 22, 1995

[51] Int. Cl.[6] ..... B24D 11/00

[52] U.S. Cl. ..... 51/298; 51/307; 51/293; 451/527

[58] Field of Search ..... 51/293, 296, 298, 51/307; 451/527

[56] References Cited

U.S. PATENT DOCUMENTS

| | | | |
|---|---|---|---|
| 5,203,883 | 4/1993 | Perry | 51/306 |
| 5,209,760 | 5/1993 | Wiand | 51/298 |
| 5,273,558 | 12/1993 | Nelson et al. | 51/298 |
| 5,489,233 | 2/1996 | Cook et al. | 51/298 |
| 5,514,192 | 5/1996 | Grigsby, Jr. | 51/296 |
| 5,551,960 | 9/1996 | Christianson | 51/295 |

FOREIGN PATENT DOCUMENTS

| | | | |
|---|---|---|---|
| H4 11335 | 2/1992 | Japan | B24D 11/00 |

*Primary Examiner*—Deborah Jones
*Attorney, Agent, or Firm*—Harry G. Weissenberger, Inc.

[57] ABSTRACT

A clogging phenomenon in the surface layer of the contact face of a soft plastic-and-abrasive composite for polishing painted surfaces, which reduces the efficiency of the polishing work, is alleviated by mixing into the soft plastic backing material of the composite containing abrasive fine particles, non-abrasive globular particles preferably formed out of bubble material. The globular particles are rotatable in the surface layer of the contact face of the soft backing when the composite is in rubbing contact with the surface to be polished. Water or a surfactant may be interposed between the surface to be polished and the composite. The surface to be polished is rubbed with the composite to remove contaminating substances adhering to the surface to be polished.

17 Claims, 3 Drawing Sheets

METHOD AND COMPOSITION FOR POLISHING PAINTED SURFACES

FIELD OF THE INVENTION

This invention relates to a method and composition for grinding and removing adhering particles, e.g. paint mist, iron powder dust, soot particles, volcanic ash, yellow sand, or pitch tar from painted surfaces or glass surfaces.

BACKGROUND OF THE INVENTION

When vehicles are left at parking lots close to a railroad or iron plant, or near a building construction site under painting work, iron powder or paint mist are blown through the air, scattered over the painted surface of the vehicles and adhere as small protrusions on the surface.

In addition, the glass surfaces of the vehicles or buildings, unless wiped at regular intervals, are subject to the adhesion of dirt, e.g. ash or pitch tar, thereon. These tend to crystallize into forms which are difficult to remove with a detergent-soaked cloth.

Adherents in the shape of small protrusions on painted or glass surfaces are normally removed by a polishing compound or fine sandpaper, which is prone to damage the painted surface itself. For this reason, there has long been a need for a way to effectively remove adherents from both types of surfaces without damaging them.

To satisfy this need, applicant has previously proposed a plastic soft whetstone in JPN. publication No. H4-11335, the whetstone comprising a soft body whose plasticity is maintained at the time of use, and into which abrasive fine particles, e.g. silica sand and calcium carbonate with a predetermined particle size are mixed.

With this plastic soft whetstone pressed against the painted surfaces, the abrasive fine particles on the contact face of the body are uniformly pressed into the soft body, so that the painted surfaces remain undamaged by the abrasive fine particles, even if the whetstone is rubbed on the painted surfaces. On the other hand, small adherent protrusions which have adhered to the painted surface penetrate through the contact face into the soft body when the whetstone is pressed against the painted surface. When the whetstone is rubbed over the surface, the small protrusions are therefore dragged through the contact surface and run up against the abrasive fine particles contained in the soft body. As the whetstone is moved, the passage of the abrasive fine particles over the adherent protrusions grinds down the small protrusions. Thus fragments of ground small protrusions remain in the soft body.

Repeated rubbing of this soft whetstone, however, causes accumulation of ground waste from the protrusions on the contact face, resulting in a clogging phenomenon (a phenomenon in which the grinding action of the abrasive fine particles stops due to the accumulation of the ground waste from the protrusions). This requires re-kneading of the soft backing so that the used contact face may be brought into the inside of the whetstone to expose a renewed contact face. Frequent modification of the whetstone through such re-kneading, however, results in a deterioration of the efficiency of the grinding action.

On the other hand, the soft whetstones have a large viscosity depending on the constituents of the backing. Because of this, application of water or other lubricants onto the contact face or the painted surface has been proposed so that its lubricity may be better sustained. Unless this kind of soft whetstone has sufficient sustained lubricity, friction causes abrasive fine particles to be rubbed against the surface to be polished, resulting in damage to the paint.

Further, water used in this manner is normally applied by soaking the soft whetstone in water in a vessel such as a bucket. Because of its heavy specific gravity, the soft whetstone sinks to the bottom of the vessel. There likely are, however, sand or dust deposits on the bottom of the vessel, which adhere to the contact face of the soft whetstone in the water. These deposits on the whetstone are, therefore, rubbed into the contact face in a subsequent use of the whetstone, resulting in damage to the contact face or paint.

SUMMARY OF THE INVENTION

It is an object of the present invention to provide a composite for polishing painted surfaces which reduces the clogging phenomenon in the contact face and therefore contributes to improving the polishing efficiency.

Another object of this invention is to provide a composite for polishing painted surfaces which can smoothly be rubbed without application of water, and without damage to the painted surface even in the hands of an inexperienced user.

Further, it is another object of this invention to provide a composite which floats when immersed in water, thereby avoiding problems caused by deposits in the water-containing vessel.

For achieving its purposes, the composite according to the present invention comprises a plastic soft body in which are dispersed abrasive fine particles and non-abrasive globular particles which are incapable of grinding but are rotatable in the surface layer of the contact face of the soft body when the composite is in rubbing contact with the surface to be polished.

It is a basic requirement of the invention that the plastic soft body be made of a soft material whose plasticity remains substantially constant even through extended periods of non-use. For example, in the case of compositions whetstones used for surface polishing, i.e., for only removing small protrusions while avoiding polishing of the painted surfaces, appropriate body substances include petroleum resins with little elasticity, e.g. polyolefin, polyol, or equivalents. For compositions used also in surface polishing for removing oil film or scattered rust spots, etc., oil-based paste or visco-elastic materials with or without a suitable plastic material added thereto may be selected.

Selection of the abrasive fine particles varies, depending on the kinds of adherents on the surface to be polished. The choice, however, is limited to those with relatively high solidity, e.g. silica sand, calcium carbonate, alumina, and green carborundum. One or more of these in combination may be used. The preferred particle size of the abrasive fine particles is 3 to 50 μgm, especially for grinding only small protrusions. This is because the grinding ability is poor if the particle size is less than 3 μm, while there is a danger of the particles becoming caught on the contact face if their size is greater than 50 μm.

The globular particles are advantageously formed in a globular shape of less than about 3 mm in diameter but larger than the abrasive particles. They are made of a non-abrasive material, e.g. synthetic resin, rubber or pulp. Taking into consideration the physical properties of the plastic soft body and the particle size of the abrasive fine particles, the globular particles, when mixed into the plastic soft body, are chosen to be of such material, particle size and amount that the globular particles positioned at the contact face in the plastic soft body may be rotated in the contact face by frictional forces from the surface to be polished when the composite is pressed into contact with the surface and then rubbed.

The plastic soft body or composite is preferably mixed with fine fibrous material as an additional constituent. This material consisting of e.g. cotton fiber is adopted for the enhancement of bonding forces and tension forces in the composite, and is effective especially when a large proportion of globular particles or abrasive particles are mixed into the composite.

The composite thus composed is preferably set to have a specific gravity of less than 1. For this purpose, materials with low specific gravity, e.g., foam material, is selected for the globular particles, and their proportion is adjusted in the mix as necessary. Of course, use of light-weight abrasive particles is also very helpful.

The method according to this invention is characterized by pressing the composite against the surface to be polished and rubbing the same on the surface, while interposing water or a surfactant between the surface to be polished and the contact face of the composite.

The water or surfactant may be sprayed over the surface to be polished or directly applied to the contact face of the composite. Conventional detergents may be used as the surfactant.

The inventive composite operates similarly to applicant's above-mentioned prior invention in that the composite undergoes plastic deformation so that its contact face pressed into contact with the surface to be polished conforms thereto regardless of whether it is stationary under pressure or is being rubbed. Another similarity is also found in causing the small protrusions which enter through the contact face into the plastic soft body to be forced against the abrasive particles in the contact face, thereby removing the protrusions from the surface to be polished.

Mixed, however, into this composite are the globular particles. These are pressed into the plastic soft body just like the abrasive fine particles when the composite is pressed against the surface to be polished but differ from the abrasive fine particles in that part of their spherical surface is uniformly exposed to the contact face. Therefore, numerous globular particles on the contact face are rotated within the surface layer of the contact face under the action of two forces the frictional force from the surface to be polished and the collision force between the globular particles and the small adherent protrusions on the surface to be polished when the composite is pressed against the surface and rubbed.

With this rotation, the rear side of the globular particles which is surrounded by abrasive particles in the soft body, in the direction of movement of the composite, is forced upward (i.e. inward from the contact face) along the spherical surface of the globular particles, while the forward side in the direction of motion of the composite is forced downward (i.e. outward from the contact face) along the spherical surface of the globular particles, resulting in a twist phenomenon on the entire contact face along with the rotation of the globular particles. This eliminates the accumulation of the ground wastes in portions of a very thin layer in the contact face. The rotation of the globular particles allows the plastic soft body to be rubbed on the surface to be polished, even when highly viscous material is used for the soft body, without interposition of any lubricant such as water, and without reducing the grinding effect.

With water or surfactant interposed between the surface to be polished and the contact face, the globular particles cause little frictional force against the surface to be polished but are subject to a rotating force resulting from the particles contact with the small adherent protrusions on the surface to be polished. For this reason, the twist phenomenon of the composite is presented on the contact face, in similar manner to that discussed above.

When the specific gravity of the composite is set at less than 1, the composite floats on water. This prevents any deposits from adhering to the surface on the composite, even when the composite is thrown into a bucket containing some sediment.

Formation of the globular particles out of foam material advantageously assists in the production of a composite with low specific gravity. Moreover, this material ensures the rotation of the globular particles in the contact face by its delicate sensing of the roughness of the small adherent protrusions on the surface to be polished.

DESCRIPTION OF THE PREFERRED EMBODIMENT

Hereinbelow, one embodiment of the present invention will be described in conjunction with drawings.

Figure 5:
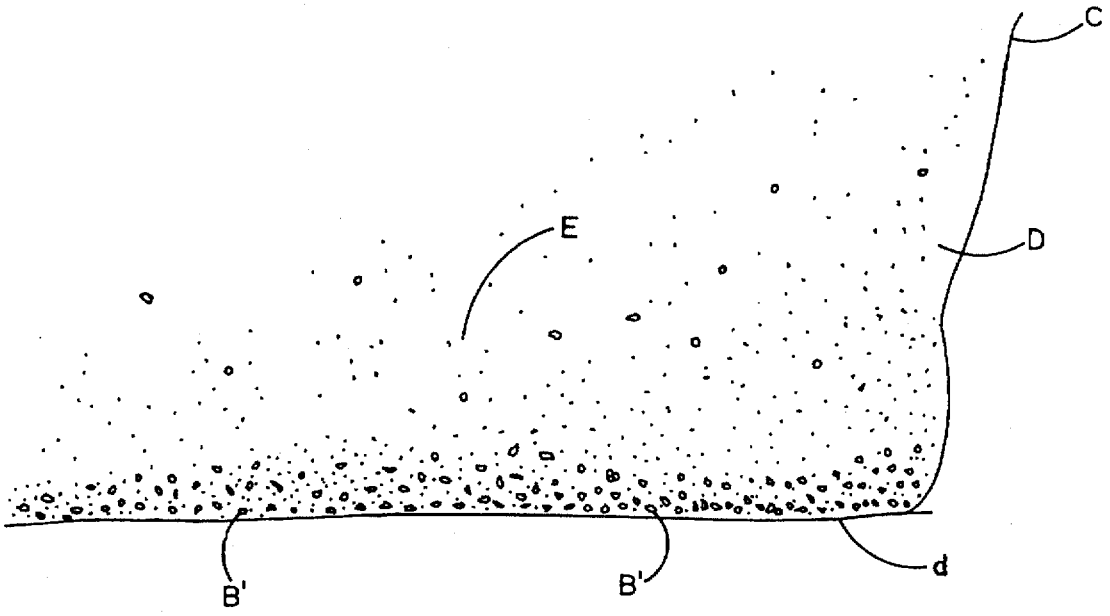
FIG. 5 is a sectional view of the structure of the contact face after a prior art grinding operation.

150 g of polyolefin polyol was used as a plastic soft body, into which 700 g of abrasive fine particles (mixture of calcium carbonate and silica sand) of 20 to 30 μm particle size and 5 fine cotton fiber were mixed. Three sets of the thus prepared mixture were each further mixed with globular particles formed from blown styrol of about 1 μm diameter in the amounts, respectively, of 17.1 g (weight ratio: about 2%), 25.6g (weight ratio: about 3%) and 34.2 g (weight ratio: about 4%), whereby three kinds of the composite, each different in specific gravity (1.23 and 1.14 and 0.98) were obtained. Using these composites and a comparison specimen free of globular particles but otherwise of the same composition as above, a test was conducted to remove contaminating materials (paint mist of about 0.5 mm in thickness and of about 0.8 mm in diameter) scattered on a painted steel plate within predetermined areas. The comparison specimen, while moved in a reciprocating rubbing manner on the painted surface, became clogged in a few minutes as shown in FIG. 5. As a result, it took about 30 minutes in total to restore a clean painted surface through re-kneading and moving the specimen in the reciprocating rubbing manner to remove the contaminants.

Figure 3:
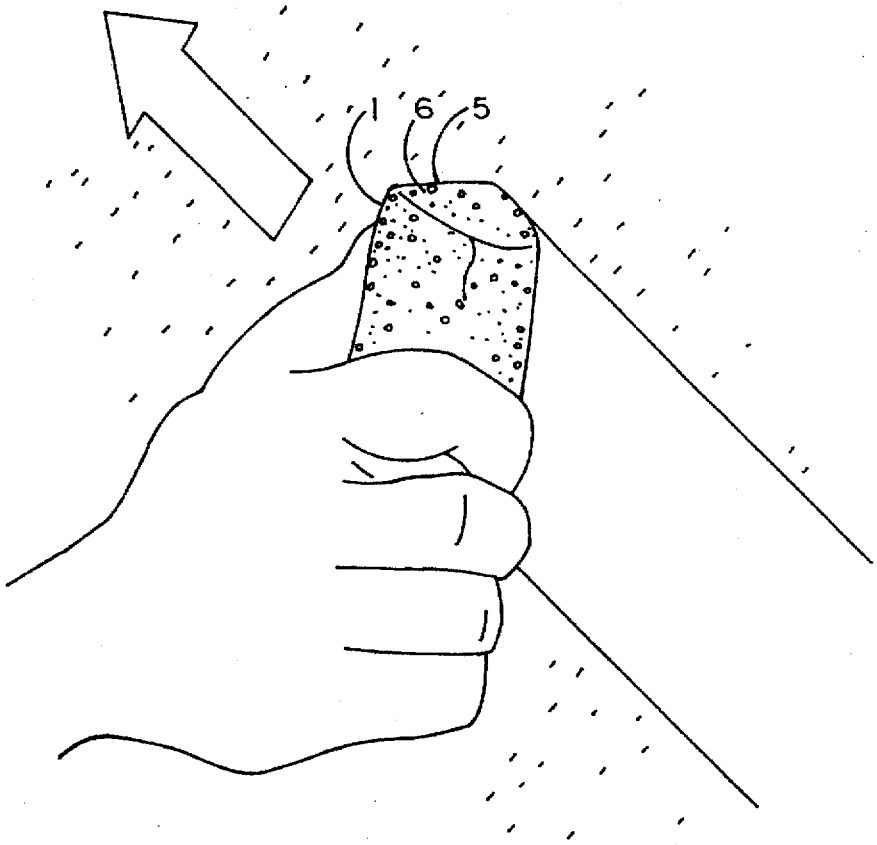
FIG. 3 is a perspective view of a condition of use of the composite of FIG. 2.
Figure 4:
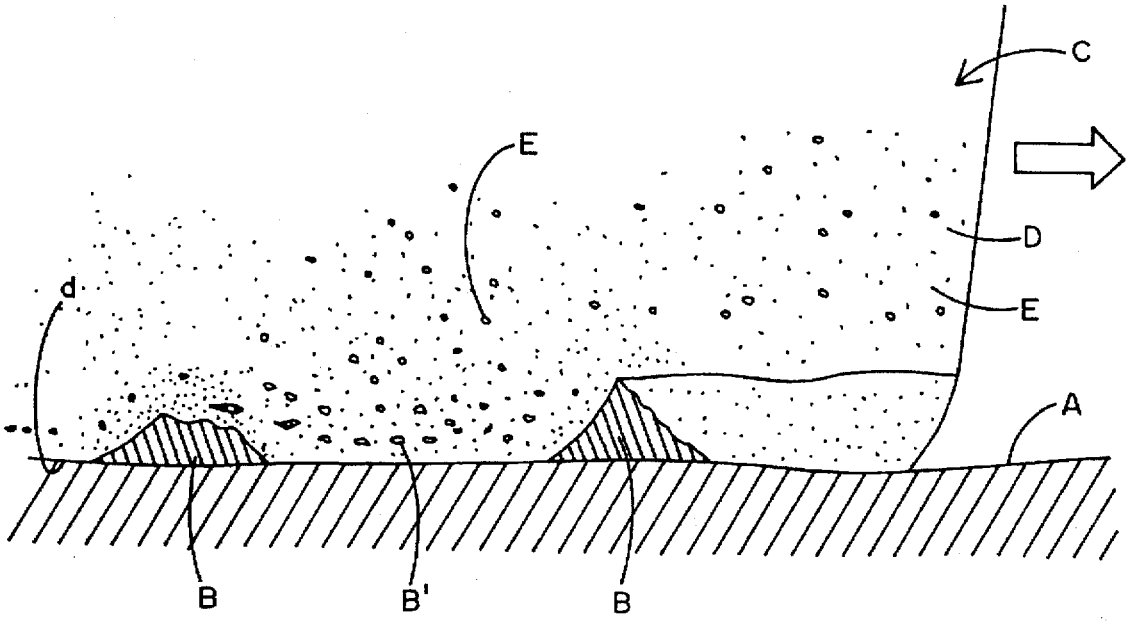
FIG. 4 is an enlarged sectional view of contact face illustrating the grinding principle of the prior art.

On the other hand, with the present composites, removal of the contaminating paint mist was achieved in about 10 minutes by reciprocating the composite on the painted surface in a similar manner to that used with the compared specimen as shown in FIG. 3. This removal, in each case, was accomplished without re-kneading the composite. The reason for this will now be described with reference to FIG. 1.

In the contact face 3 of the composite 2 which was pressed against the painted surface 1, globular particles 5 are pressed into the portion 6 of the plastic soft body 2 adjacent the contact face 3 in the same manner as the abrasive fine particles 4. The abrasive fine particles 4 are stuck in the portion 6 under a continuing uniform reaction force from the painted surface 1 and never protrude through the contact face 3, so that the painted surface 1 is free from damage even if the inventive composite is rubbed over the surface. Of the globular particles 5, a part of the spherical surface of those positioned on the contact face is pressed against the painted surface 1.

Figure 1:
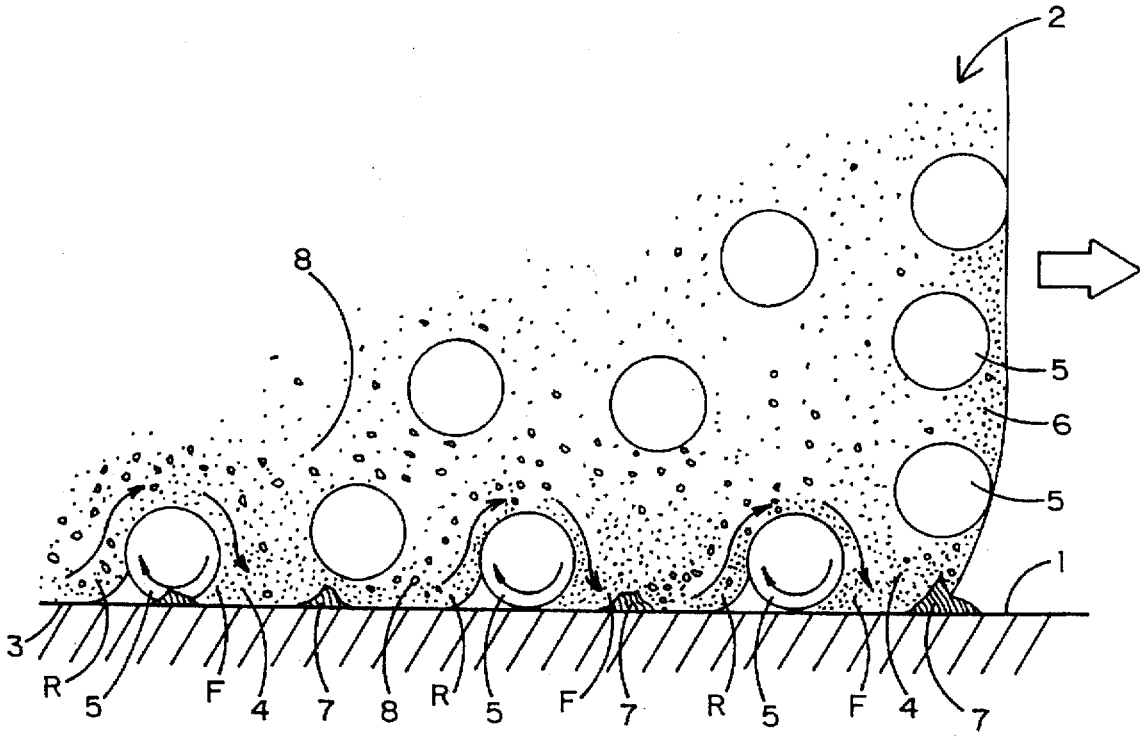
FIG. 1 is an enlarged sectional view of the structure of the contact face showing the movement of the globular particles during use of the composite according to one embodiment of the present invention.

With the present composite 2 moved in the direction of the thick arrow in FIG. 1 (rightward in the drawing), the globular particles 5 are thus rotated clockwise by the frictional force. This rotating force is also produced when the globular particles run up against mist protrusions 7 on the painted surface.

The rotating globular particles 5 move the portion 6 containing the abrasive fine particles around their spherical surfaces as shown in the direction of the arrow in FIG. 1. At the forward side F of the globular particles 5 in the leading direction of movement of the composite 2, the rotation of globular particles 5 continuously drives a new portion 6 of the composite body 2 including abrasive fine particles out of the inside of the body 2 toward the contact face 3. These abrasive particles are then driven against the mist 7 which has entered into the surface layer and thereby grind the mist protuberances. By contrast, at the rearward R in the direction of motion of the composite 2, the portion 6 adjacent the contact face 3 is forced upward, with the ground wastes 8 from the mist protuberances 7 moving into the inside of the composite body 2.

Because of the above-described twist phenomenon about the globular particles 5 in the surface layer of the backing 6, the inventive composites 2 have the clog near the contact face reduced. The admixing of cotton fiber into the composite, and to some extent the viscosity of the body itself, assist in preventing the body from being broken into pieces by the twist phenomenon.

Figure 2:
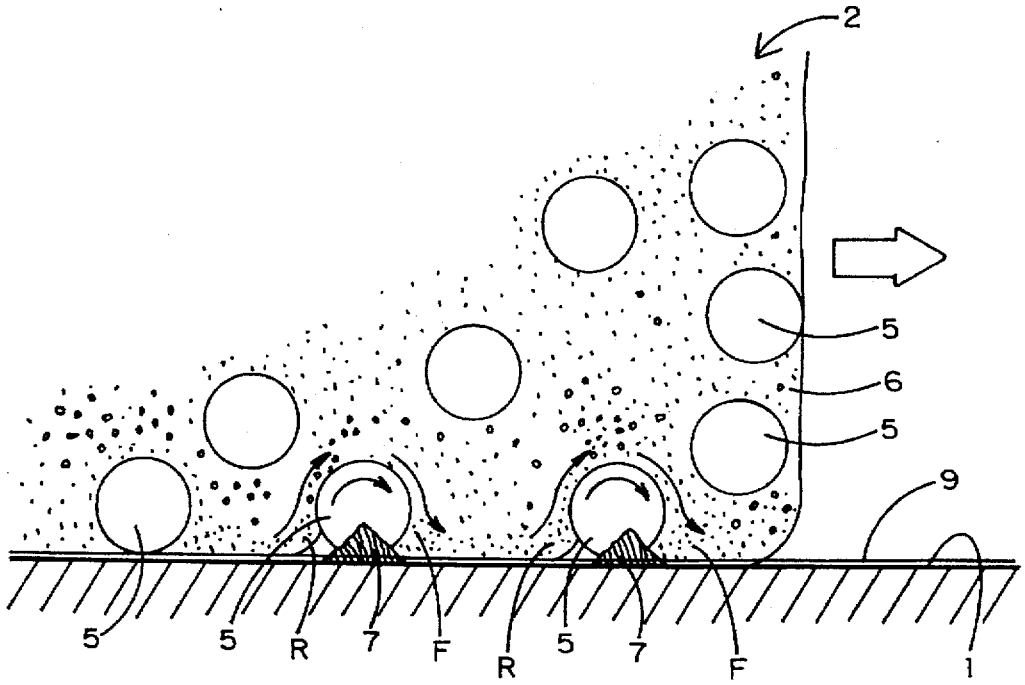
FIG. 2 is an enlarged sectional view of the structure of the contact face showing the movement of the globular particles in another condition of use of the composite according to one embodiment of the present invention.

FIG. 2 shows a grinding action on the paint mist 7 with an application of water or surfactant 9 between the composite 2 and the painted surface 1. Here, the globular particles 5 are rotated mainly when colliding with paint mist protuberances 7. When the paint mist protuberances are removed, the globular particles 5 are therefore never rotated even when the composite 1 is rubbed on the painted surface 1.

Of the three above-described samples of the composite 2, the third had a specific gravity less than 1. This prevented the composite itself from sinking even when soaked into a vessel with water therein, eliminating the problem of deposits in the vessel and allowing more efficient work when water was being applied. On the other hand, the comparison specimen sank in the vessel because its specific gravity was 2.01. Various kinds of dust or sand in the vessel bottom adhered to the surface of the comparison sample after soaking, thereby resulting in a noticeable detrioration in work efficiency.

According to the present invention as described above, with the globular particles 5 rotating in the contact face 3 during rubbing contact with the surface 1 to be polished, the plastic soft body containing the abrasive particles in the contact face is twisted in the area of the contact face, thereby continuously supplying new abrasive layers for the contact face. As a result, no re-kneading is necessary for long intervals, thus reducing the time needed for the abrasive work.

Also, according to the present invention, the rotation of the globular particles reduces frictional resistance between the contact face and the surface to be polished to the fullest extent possible. This allows even inexperienced persons to easily grind and remove contaminating substances such as paint mist without interposing water between the surface to be polished and the contact face, especially when material with poor viscosity is used as plastic soft backing.

Moreover, use of low specific gravity globular particles and floating the composite on the water makes it possible to avoid damage of the surface to be polished by deposits in the water-containing vessel which adhere to this kind of composite.

According to the method of the present invention, removal of adherents on a surface to be polished is ensured without frequent re-kneading as mentioned above, even when using materials of low viscosity for the plastic soft backing.

I claim:

1. A composite for polishing painted surfaces, comprising:

a) a soft plastic body having a contact face adapted to contact a surface to be polished;

b) abrasive particles embedded in said body at least in proximity to said contact face in an amount effective to polish said surface when said contact face is rubbed against said surface;

c) non-abrasive globular particles embedded in said body at least at said contact face in an amount and size effective to move said abrasive particles toward and away from said contact face when said globular particles are rotated in said contact face, said globular particles at said contact face being adapted to rotate in said contact face when said contact face is rubbed against said surface.

2. The composite of claim 1, in which said body further includes fine fibrous materials dispersed therein.

3. The composite of claim 1, in which said globular particles consist of synthetic resin material.

4. The composite of claim 1, in which said composite has a specific gravity less than 1.

5. The composite of claim 1, in which said globular particles consist of foam material.

6. The composite of claim 1 in which said globular particles have a particle size which is larger than that of said abrasive particles and is substantially 3 mm or less in diameter.

7. The composite of claim 1 in which said body is mainly composed of polyolefin polyol.

8. The composite of claim 1 in which said body is mainly composed of visco-elastic material.

9. The composite of claim 1 in which said abrasive fine particles have a particle size of substantially 3 to 50 μm.

10. A polishing method, comprising the steps of:

a) placing a contact face of a composite in contact with a painted surface to be polished, the composite comprising a soft plastic body containing a dispersion of abrasive particles in an amount effective to polish said surface and non-abrasive globular particles said globular particles being rotatable in said contact face when said contact face is in rubbing contact with a surface to be polished; and b) rubbing said composite on said surface to be polished with a substance selected from the group consisting of water or surfactant present on said surface and said contact face, whereby extraneous substances adhering to the surface to be polished are removed.

11. The method of claim 10, in which said substance is applied to said surface to be polished and said composite is pressed against said surface to be polished for rubbing the same.

12. The method of claim 10, in which said substance is applied to at least said contact face of said composite, and said surface to be polished is rubbed with said composite while pressing said composite thereagainst.

13. The method of claim 10, in which said substance is water.

14. The method of claim 10, in which said substance is surfactant.

15. The composite of claim 1, in which said abrasive particles are dispersed in said body adjacent said contact face in the ratio of substantially 700 g of abrasive particles per 150 g of said soft plastic body.

16. The composite of claim 1, in which said abrasive particles are selected from the group consisting of silica sand, calcium carbonate, alumina, and green carborundum.

17. The composite of claim 1, in which the material of said nonabrasive globular particles is chosen from the group consisting of synthetic resin, rubber and foam materials.

* * * * *